US007591437B2

(12) United States Patent
Nilsson et al.

(10) Patent No.: US 7,591,437 B2
(45) Date of Patent: Sep. 22, 2009

(54) METHOD AND DEVICE FOR CONTROLLING A CRUSHER, AND A POINTER INSTRUMENT FOR INDICATION OF LOAD ON A CRUSHER

(75) Inventors: Anders Nilsson, Limhamn (SE); Johan Gullander, Malmö (SE); Kjell-Åke Svensson, Limhamn (SE); Kent Nilsson, Malmö (SE); Mattias Nilsson, Sjöbo (SE)

(73) Assignee: Sandvik Intellectual Property AB, Sandviken (SE)

( * ) Notice: Subject to any disclaimer, the term of this patent is extended or adjusted under 35 U.S.C. 154(b) by 109 days.

(21) Appl. No.: 10/544,652

(22) PCT Filed: Feb. 9, 2004

(86) PCT No.: PCT/SE2004/000162

§ 371 (c)(1),
(2), (4) Date: Jun. 7, 2006

(87) PCT Pub. No.: WO2005/007293

PCT Pub. Date: Jan. 27, 2005

(65) Prior Publication Data

US 2006/0243833 A1 Nov. 2, 2006

(30) Foreign Application Priority Data

Feb. 10, 2003 (SE) ..... 0300327

(51) Int. Cl.
*B02C 25/00* (2006.01)

(52) U.S. Cl. ..... 241/30; 241/34; 241/36; 241/37

(58) Field of Classification Search ..... 241/30, 241/33–37

See application file for complete search history.

(56) References Cited

U.S. PATENT DOCUMENTS 3,117,734 A * 1/1964 McCarty et al. ..... 241/29

(Continued)

FOREIGN PATENT DOCUMENTS

JP 62-193655 8/1987

(Continued)

OTHER PUBLICATIONS

Derwent Abstract 1987-275540, Aug. 25, 1987 (attached to JP62-193655).

*Primary Examiner*—Mark Rosenbaum
(74) *Attorney, Agent, or Firm*—Drinker Biddle & Reath LLP

(57) ABSTRACT

A crusher has first and second crushing elements spaced apart to form a crushing gap therebetween. A measuring device is arranged to measure the instantaneous load on the crusher during at least one period to obtain a number of measured values. A calculation device is arranged to calculate a representative load value that is representative of the highest, measured instantaneous load during each such period of time. A control device is arranged to compare the representative load value with a desired value and to control the load on the crusher depending on the comparison.

13 Claims, 7 Drawing Sheets

U.S. PATENT DOCUMENTS 3,480,212 A * 11/1969 Schubert et al. ..... 241/34
4,179,921 A 12/1979 Cook et al.
4,712,743 A * 12/1987 Nordin ..... 241/30
4,856,716 A 8/1989 Burstedt
5,580,003 A 12/1996 Malone et al.
6,182,914 B1 * 2/2001 Carle ..... 241/30

FOREIGN PATENT DOCUMENTS

SE 456138 9/1987
WO WO 87/05828 10/1987

* cited by examiner

METHOD AND DEVICE FOR CONTROLLING A CRUSHER, AND A POINTER INSTRUMENT FOR INDICATION OF LOAD ON A CRUSHER

TECHNICAL FIELD OF THE INVENTION

The present invention relates to a method for controlling a crusher at which material to be crushed is inserted into a gap between a first crushing means and a second crushing means.

The present invention also relates to a pointer instrument for indication of the load on a crusher, which is of the kind mentioned above.

The present invention also relates to a control system for control of the load on a crusher, which is of the kind mentioned above.

TECHNICAL BACKGROUND

A crusher of the above-mentioned type may be utilized in order to crush hard material, such as pieces of rock material. It is desirable to be able to crush a large quantity of material in the crusher without risking that the crusher is exposed to such mechanical loads that the frequency of breakdowns increases.

WO 87/05828 discloses a method to decrease the risk of increased mechanical load and breakdowns resulting therefrom. The number of pressure surges above a certain predetermined level that arise in the hydraulic fluid that controls the position of the crushing head are counted. If the count of pressure surges exceeds a predetermined amount, the relative position of the crushing shells is changed so that the width of the crushing gap increases. Preferably, the number of times that the gap is increased during a predetermined time is also counted after which alarm is given if said number of times exceeds a predetermined amount.

The method disclosed in WO 87/05828 may to a certain extent reducing the risk of the crusher breaking down prematurely, but does not increase the efficiency of the crusher as regards the amount of crushed material per unit of time.

SUMMARY OF THE INVENTION

An object of the present invention is to provide a method for controlling a crusher, which method increases the efficiency of the crusher in respect of accomplished crushing work, which, for instance, may result in increased size reduction of a certain quantity of material or increased quantity of crushed material, in relation to the prior art technique. This object is attained by a method for controlling a crusher, which is of the kind mentioned above, which method is characterized by the following steps:

a) that the instantaneous load on the crusher is measured during at least one period of time to obtain a number of measured values, b) that a representative value, which is representative of the highest measured instantaneous load during each such period of time, is calculated, and c) that the representative value is compared to a desired value and that the load on the crusher is controlled depending on said comparison.

An advantage of this method is that the control is based on a value that is representative of the highest instantaneous loads, also called the load peaks, on the crusher, i.e., the loads that involve highest risk of mechanical damage on the crusher. Thanks to this, an operator can be sure that the function of the crusher is not risked, irrespective of how the crusher is supplied with material. The operator can, by ensuring that the supply of material to the crusher becomes even as regards, among other things, quantity of material, moisture content, size distribution and hardness, decrease the highest instantaneous loads. Thereby, the crusher can operate at a high average load without increasing the risk of breakdown. In crushes that have an even supply and a material which does not cause high load peaks, the method according to the invention will mean that the crusher operates at a higher average load, which means a higher efficiency, than what previously has been possible. In crushes that have an uneven supply, the method according to the invention will enable incentive to alter the supply so that it becomes more even with the purpose of providing a more efficient crushing. The control of desired value is normally a stable and safe type of control. Thus, the desired value is suitably selected to be the highest load that the crusher can operate at without increased risk of mechanical breakdown. Thus, the crusher can be utilized optimally without increasing the risk of breakdown in cases of uneven supply or unusually hard material. The desired value can be locked by the one delivering the crusher, wherein the operator, which cannot affect the desired value, may make alterations in the supply of material with the purpose of increasing the efficiency of the crusher without, because of this, risking mechanical damage. In certain cases, it may, however, be appropriate to let the operator increase the desired value and consciously accept a calculated increase of the number of mechanical breakdowns in order to increase the efficiency of the crusher further. Also, other ways of choosing and/or controlling the desired value are possible.

According to a preferred embodiment, step a) also comprises that a sequence of data is formed, which data consist of determinations of the highest load on the crusher in each one of said periods of time, which consist of a plurality of consecutive periods of time. The formation of a sequence of data, where each data is the highest load during a period of time included in the sequence, gives a control that in an advantageous way represents the highest loads. The division into periods of time makes, among other things, that occasional very high load peaks get a limited influence on said representative value. According to an even more preferred embodiment, said representative value is calculated in step b) as a mean value of data included in said sequence. A mean value gives a relevant picture of the load peaks for the control.

Preferably, said periods of time follow immediately upon each other. An advantage of this is that also fast courses of events are recorded quickly and may be handled by the control, for instance a rapidly and heavily increasing load may quickly be compensated for, the risk of mechanical damage decreasing.

Suitably, measured values are used continuously during operation of the crusher for forming a plurality of sequences of data. An advantage of this is that the control may be based on an almost continuous inflow of sequences and representative values calculated therefrom. The control may thereby quickly react on alterations in the operation of the crusher. Even more preferred is that, upon calculation of said representative value of a current sequence, at least one data is utilized concerning highest load that already has been utilized in an immediately preceding sequence. In this way, the sequences will overlap each other. An advantage of this is that said representative value will be calculated several times per unit of time. This means that the control more often receives new input data and makes that the control better can monitor the actual course in the crusher.

Preferably, all sequences include the same number of data concerning highest load. Preferably, said data amounts to at least five for each sequence. At least five data for each sequence makes that occasional very high or very low load peaks get a limited influence on said value, a desired damping of the control being provided.

According to a preferred embodiment, at least the highest and/or the lowest of the data included in the sequence concerning highest load is excluded upon calculation of said representative value of the same sequence. In this way, it is avoided that occasional very high and/or low values, which, for instance, may depend on erroneous measurements or occasional hard objects, get an undesired large influence on the representative value that then is calculated for the current sequence.

According to an even more preferred embodiment, at least the highest as well as at least the two lowest values of the data included in the sequence concerning highest load are excluded upon calculation of said value of the same sequence, more of the lowest than of the highest values being excluded. An advantage of this is that it is avoided that the control system "is fooled" to increase the load by virtue of a sequence randomly happening to contain a plurality of periods of time with relatively low highest loads. If these periods of time with low highest loads suddenly are followed by a very high highest load at the same time as the control system already ordered increase of the load, there is a risk of mechanical damage. Thanks to the fact that more of the lowest values in the sequence are excluded, the highest peaks get a greater impact and the system becomes more sensitive to the high peaks and can easier avoid that the load rises much above the desired value. A consequence of this becomes that the desired value can be raised somewhat, with an increased crushing capacity as a consequence, without increased risk of mechanical breakdowns.

According to a preferred embodiment, the width of the gap is adjustable by means of a hydraulic adjusting device, in step a) the load being measured as a hydraulic fluid pressure in said device. The hydraulic fluid pressure frequently gives a very quick and relevant indication of the condition in the crusher. Thus, the risk of possible delays or fault indications causing mechanical breakdowns decreases.

According to another preferred embodiment, in step a) the load is measured as the power of the crusher driving device. The power of the driving device frequently gives a quick and relevant feedback of the load on the crusher. Control based on the power of the driving device is particularly suitable when the capacity of the driving device is what limits the feasible load on the crusher and also at cases when the adjusting device is not of a hydraulic type. The power of the driving device may, for instance, be measured directly as an electric power, if the driving device is an electric motor, be calculated from a hydraulic pressure, if the driving device is a hydraulic motor, or, if the driving device is a diesel engine, from a developed engine power.

According to an additional preferred embodiment, in step a) the load is measured as a mechanical stress on the crusher. An advantage of this is that it is possible to choose the component that is the most critical one for the mechanical strength of the crusher and measure a stress, such as a tension or a strain, which is representative of the stress on the same component. Thereby, a direct control of the load in relation to the load that the crusher withstands mechanically is obtained. It is, as mentioned above, not necessary to measure on the very critical component. On the contrary, it may frequently be appropriate to measure a mechanical stress in a place, the stress of which correlates well against the stress on the most critical component. Another advantage is that the mechanical stress may be utilized as a measure of load also in cases when the adjusting device is not hydraulic and in cases when the driving device is not limiting for the load that the crusher withstands.

In a crusher where it is possible to measure the load both as hydraulic fluid pressure, as power developed by the crusher driving device and as a mechanical stress, or at least as two of said parameters, the method may be formed with control on the load parameter of these which currently is highest in relation to the desired value thereof. Thus, during a period the load on the crusher may be controlled depending on measured highest hydraulic pressures, while during another period it may be controlled depending on measured highest powers. In this way, the crusher can always operate efficiently without risking damage on that component, for instance the hydraulic system, driving device or crusher frame, which currently is exposed to the highest load relatively seen.

According to a preferred embodiment, in step c) the load is controlled by the fact that at least some of the following steps is carried out that the width of the gap is changed, that the supply of material to the gap is changed, that the rotational speed of the crusher driving device is adjusted, and that the mutual movements of the crushing means are adjusted. Thus, the control of the load may take place in various ways and the method being selected may be adapted to the current operational situation and the load being controlled on. An alteration of the width of the gap, frequently gives a very quick alteration of the load on the crusher. In cases when, for instance, it is desired to keep the width constant, it may instead be of interest to alter the supply of material to the gap. If the driving device is exposed to a very high load, it may be suitable to alter the number of revolutions. It is also possible to combine a plural of alterations and, for instance, to alter the width of the gap and adjust the mutual movement of the crushing means simultaneously. The latter may for instance be an adjustment of how much the crushing means move to-and-fro towards each other during the crushing. One example is adjustment of the horizontal stroke of the shaft in a gyratory crusher.

An additional object of the present invention is to provide a pointer instrument for indication of load on a gyratory crusher, which instruments makes it easier to improve the efficiency of the crusher in respect of accomplished crushing work, which, for instance, may result in an increased size reduction of a certain quantity of material or an increased quantity of crushed material, in relation to prior art technique.

This object is attained by a pointer instrument, which is of the kind mentioned above and is characterized in that the pointer instrument has a first pointer, which shows a comparative value, and a second pointer, which shows a representative value, which has been determined after the instantaneous load on the crusher in one step a) has been measured during at least one period of time to obtain a number of measured values, said representative value in a step b) having been calculated as being representative of the highest measured instantaneous load during each such period of time, said comparative value being determined depending on the load on the crusher such that a comparison of the position of the first pointer and the position of the second pointer gives an indication as to whether the operation of the crusher is effective.

An advantage of this pointer instrument is that it becomes very clear to an operator that operates the crusher if the operation is efficient or not. If the first pointer shows almost equally high a pressure as the second pointer, which shows the representative value that is representative of the highest loads, it means that the operation of the crusher is efficient. If, on the other hand, the first pointer shows a considerably lower load than the second pointer, the operator gets an indication that, for instance, the supply of material to the crusher does not work satisfactory but needs be attended to. Thus, the operator gets an easily comprehensible indication of disturbances in the process. The pointer instrument also gives a clear and quick feedback on measures carried out in order to get the crusher to operate more efficiently, for instance measures in order to alter the moisture content or size distribution of the supplied material or to provide a more even inflow of material. The second pointer also gives a feedback on that the control system is working and that the load does not exceed permitted levels, which could cause mechanical breakdowns.

According to a preferred embodiment, the first and the second pointer form sides of a sector, the extension of which indicates the operation conditions of the crusher. The sector, which suitably has another color than the dial of the pointer instrument, gives a very clear visual indication of the difference between the value shown by the first pointer and the representative value representing the highest loads. For the operator, it becomes a clear goal to keep the sector as small as possible since this means an efficiently operating crusher.

According to a preferred embodiment, the first pointer shows a comparative value that represents the average load on the crusher. The average load is a good measure of the crushing work that the crusher performs. If the average load is close to the representative value, which is representative of the highest loads, it is a clear indication of the crushing operation being efficient.

According to another preferred embodiment, the first pointer shows a comparative value, which has been determined after the instantaneous load on the crusher in a first step having been measured during at least one period of time to obtain a number of measured values, said comparative value in a second step having been calculated as being representative of the lowest measured instantaneous load during each period of time. The lowest measured instantaneous loads give, together with the highest measured instantaneous loads, which are shown by the second pointer, a good picture of how much the load in the crusher varies, "beating" up and down, and give indication if something should be altered in order to decrease the variation. As has been mentioned above, the highest loads are most serious as regards mechanical damage. However, it is also relevant to consider to the lowest loads, since a large difference between the highest and the lowest loads means substantial load shifts on the crusher, which increase the risk of mechanical-damage.

An additional object of the present invention is to provide a control system for control of the load in a crusher, which control system improves the efficiency of the crusher in respect of accomplished crushing work, which, for instance, may result in increased size reduction of a certain quantity of material or increased quantity of crushed material, in relation to the prior art technique.

This object is attained by a control system, which is of the kind mentioned above and is characterized in that it comprises a measuring device, which is arranged to measure the instantaneous load on the crusher during at least one period of time to obtain a number of measured values, a calculation device, which is arranged to calculate a representative value, which is representative of the highest measured instantaneous load during each such period of time, and a control device, which is arranged to compare said representative value with a desired value and to control the load on the crusher depending on the same comparison.

An advantage of said control system is that it increases the load at which a crusher can operate without increasing the risk of breakdown.

Additional advantages and features of the invention are evident from the description below and the appended claims.

BRIEF DESCRIPTION OF THE DRAWINGS

The invention will henceforth be described by means of embodiment examples and with reference to the appended drawings.

DESCRIPTION OF THE PREFERRED EMBODIMENTS

Figure 1:
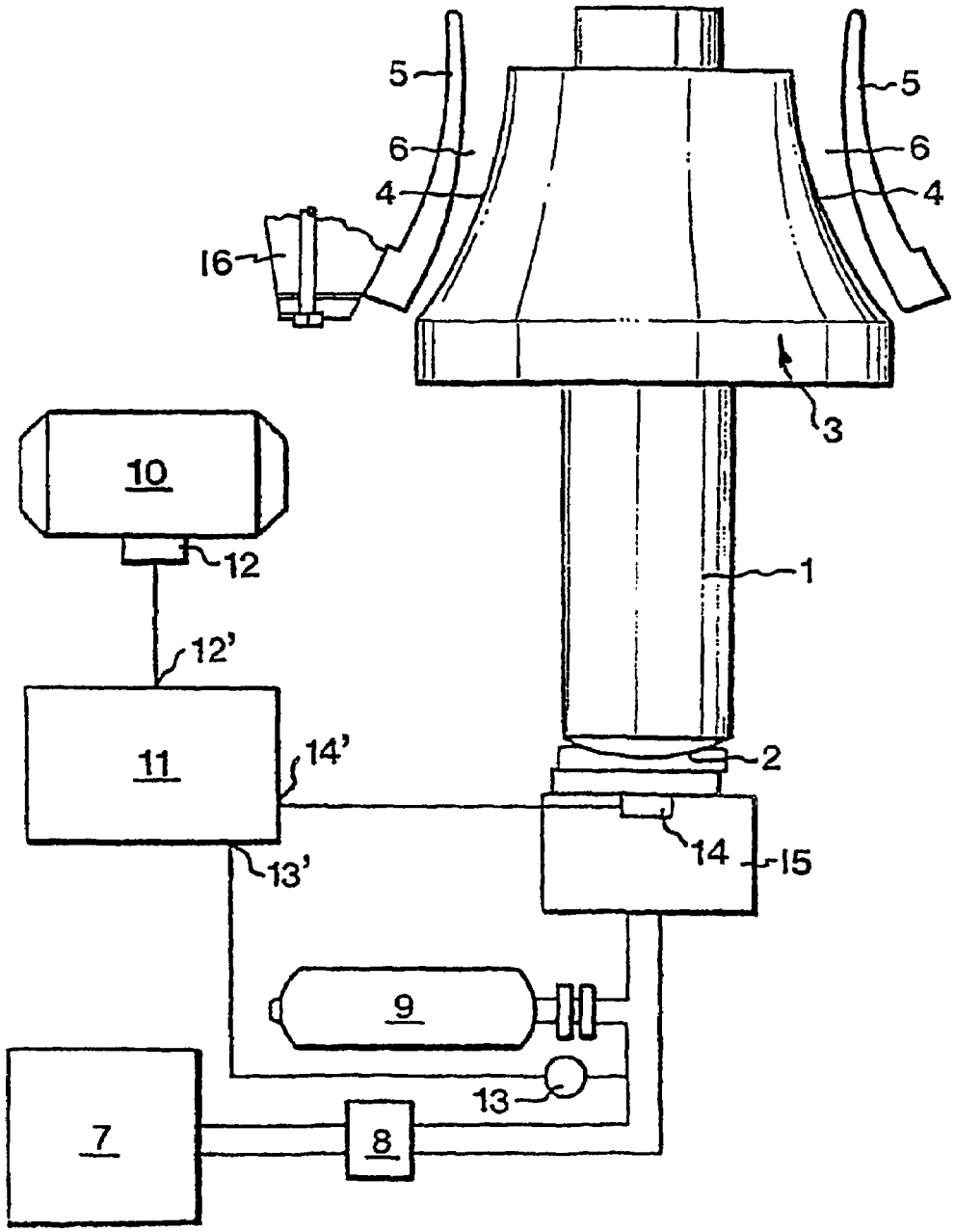
FIG. 1 schematically shows a gyratory crusher having associated driving, adjusting and control devices.

In FIG. 1, a gyratory crusher is shown schematically, which has a shaft 1. At the lower end 2 thereof, the shaft 1 is eccentrically mounted. At the upper end thereof, the shaft 1 carries a crushing head 3. A first crushing means in the form of a first, inner crushing shell 4 is mounted on the outside of the crushing head 3. In a machine frame 16, a second crushing means in the form of a second, outer, crushing shell 5 has been mounted in such a way that it surrounds the inner crushing shell 4. Between the inner crushing shell 4 and the outer crushing shell 5, a crushing gap 6 is formed, which in axial section, as is shown in FIG. 1, has a decreasing width in the direction downwards. The shaft 1, and thereby the crushing head 3 and the inner crushing shell 4, is vertically movable by means of a hydraulic adjusting device, which comprises a tank 7 for hydraulic fluid, a hydraulic pump 8, a gas-filled container 9 and a hydraulic piston 15. Furthermore, a motor 10 is connected to the crusher, which motor during operation is arranged to bring the shaft 1, and thereby the crushing head 37 to execute a gyratory movement, i.e., a movement during which the two crushing shells 4, 5 approach each other along a rotary generatrix and distance from each other at a diametrically opposite generatrix.

In operation, the crusher is controlled by a control device 11, which via an input 12' receives input signals from a transducer 12 arranged at the motor 10, which transducer measures the load on the motor, via an input 13' receives input signals from a pressure transducer 13, which measure the pressure in the hydraulic fluid in the adjusting device 7, 8, 9, 15 and via an input 14' receives signals from a level transducer 14, which measures the position of the shaft 1 in the vertical direction in relation to the machine frame 16. The control device 11 comprises, among other things, a data processor and controls, on the basis of received input signals, among other things, the hydraulic fluid pressure in the adjusting device.

When the crusher is to be started, a calibration is first carried out without feeding of material. The motor 10 is started and brings the crushing head 3 to execute a gyratory pendulum movement. Then, the pump 8 increases the hydraulic fluid pressure so that the shaft 1, and thereby the inner shell 4, is raised until the inner crushing shell 4 comes to abutment against the outer crushing shell 5. When the inner shell 4 contacts the outer shell 5, a pressure increase arises in the hydraulic fluid, which is recorded by the pressure transducer 13. The inner shell 4 is lowered somewhat in order to avoid that it "sticks" against the outer shell 5, and then the motor 10 is stopped and a so-called A measure, which is the vertical distance from a fixed point on the shaft 1 to a fixed point on the machine frame 16, is measured manually and fed into the control device 11 to represent the corresponding signal from the level transducer 14. Next, the motor 10 is restarted and the pump 8 then pumps hydraulic fluid to the tank 7 until the shaft 1 reaches the lowermost position thereof. The corresponding signal from the level transducer 14 for said lower position is then read by the control device 11. Knowing the gap angle between the inner crushing shell 4 and the outer crushing shell 5, the width of the gap 6 may be calculated at any position of the shaft 1 as measured by the level transducer 14. Usually, the width of the gap 6 is calculated in the position where the gap 6 is as most narrow, i.e. in the position where the inner shell 4 gets in contact with the outer shell 5 during the above-mentioned calibration. However, it is also possible to calculate the width at another position in the gap 6 in stead.

When the calibration is finished, a suitable width of the gap 6 is set and supply of material to the crushing gap 6 of the crusher is commenced. The supplied material is crushed in the gap 6 and may then be collected vertically below the same.

According to the present invention, a representative value is calculated, which is representative of the highest measured instantaneous loads on the crusher. As used in the present application, "load" relates to the stress that the crusher is exposed to on a certain occasion. The load may, according to the present invention, for instance, be expressed in the form of a mean peak pressure, which is calculated from hydraulic fluid pressures as measured by the pressure transducer 13. The load may also be expressed as a mean peak motor power that is calculated from motor powers as measured by the transducer 12, or as a mean peak tension that is calculated from mechanical tensions in the crusher as measured by a tension sensor, for instance a strain gauge.

Figure 2:
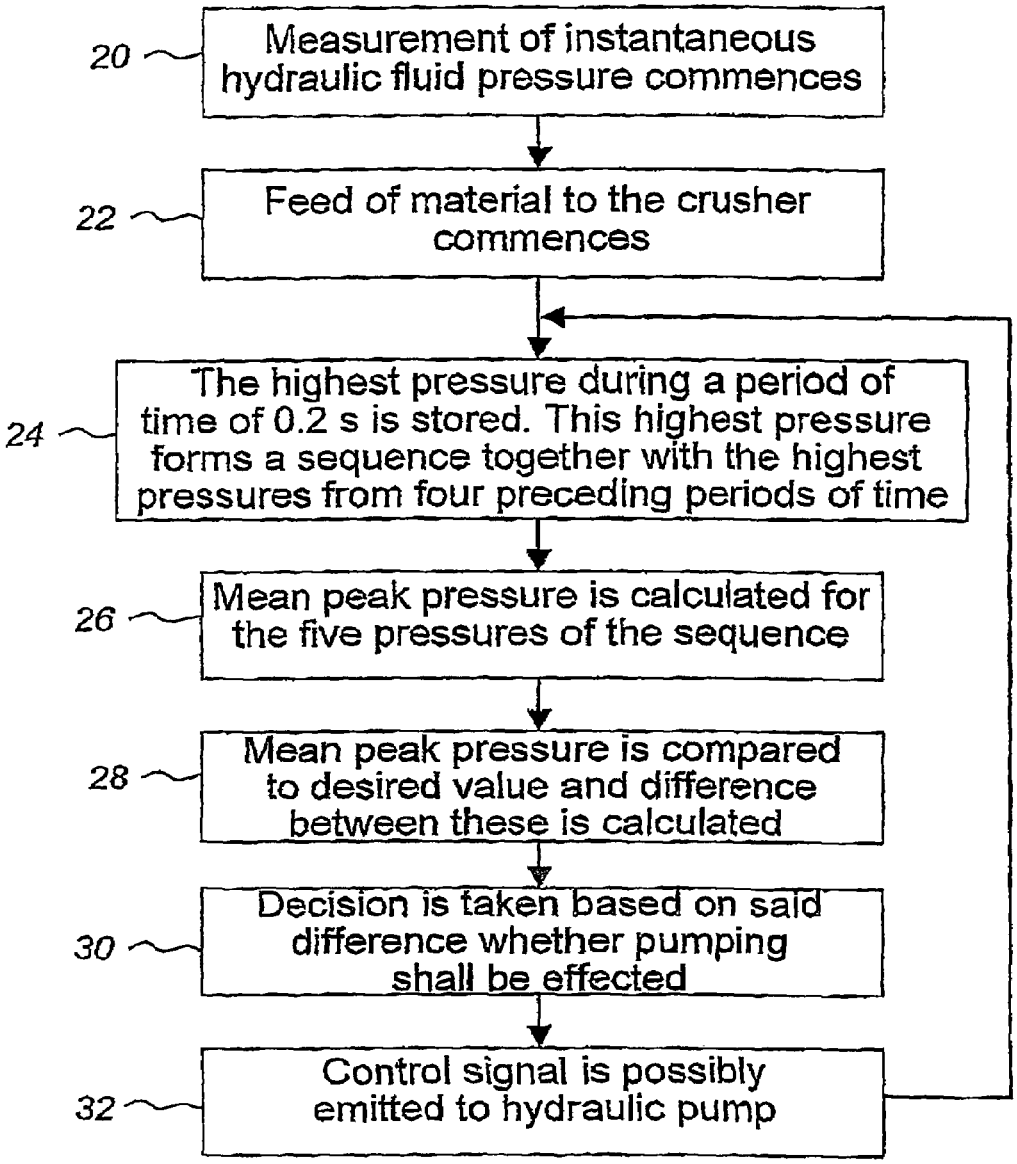
FIG. 2 shows a flow table for control of a crusher.

FIG. 2 schematically shows a method for controlling the operation of the crusher depending on the hydraulic fluid pressure. The crushing process results in a varying pressure arising in the hydraulic fluid. At a certain quantity of supplied material of a certain hardness and size, a narrow gap 6 will mean a high hydraulic fluid pressure and a wide gap 6 will mean a low hydraulic fluid pressure. A high mean hydraulic fluid pressure means that the crusher is utilized efficiently in order to crush the supplied material. Thus, it is desirable that for a certain quantity of supplied material keep as high mean pressure as possible without the crusher risking to be damaged mechanically. In the step 20 shown in FIG. 2, measurement is commenced of the instantaneous hydraulic fluid pressure in the adjusting device 7, 8, 9, 15 by means of the pressure transducer 13. The measurement of the instantaneous hydraulic fluid pressure started in step 20 continues as long as the crusher is in operation. The signal from the pressure transducer 13 is received by the control device 11. In step 22, the supply of material to the crusher is commenced. In step 24, the highest hydraulic fluid pressure that has been recorded during a period of time of 0.2 s is stored in the control device 11. The highest hydraulic fluid pressure measured in step 24 forms, together with the corresponding values for the four closest preceding periods of time, a sequence of repeated measurements of highest hydraulic fluid pressures. In stop 26, a representative value is calculated in the form of a mean peak pressure as a mean value of the highest hydraulic fluid pressures included in said sequence, which thus have been measured during each one of the five periods of time which are contained within the latest 1.0 s. Said mean peak pressure is thereby a value that is representative of the highest measured instantaneous hydraulic fluid pressures. The calculated mean peak pressure is compared with a desired value in step 28, the difference between the mean peak pressure and the desired value being calculated. The difference between the desired value and the calculated mean peak pressure obtained in step 28 is utilized in step 30 in order to determine if the pump 8 should reduce or increase the hydraulic fluid pressure in the adjusting device, the period of time the pump should be in operation and if any time should pass before a pressure alteration should be started. In step 32, the control device 11 emits a control signal to the pump 8, if the conditions for such a control signal are met, and a new sequence of measurements is initiated by step 24 again being commenced. When the hydraulic fluid pressure is increased or reduced, the shaft 1, and thereby the inner shell 4, will be raised or lowered, the gap 6 becoming more slender or wider, respectively. Thus, the hydraulic pressure alteration will affect the width of the gap 6 and thereby the load on the crusher.

The occasions when the pump 8 should be taken into operation, "pump", and how long it should pump hydraulic fluid to or from the piston 15, is thus controlled by the control device 11. The pumping tales place during a certain space of time, the length of which is proportional in steps to the difference between the current mean peak pressure and the desired value, i.e., if the current mean peak pressure is within a certain interval at a certain distance from the desired value, pumping is effected during a certain time, while if the current mean peak pressure is in an interval which is closer to the desired value, the pumping is effected during a shorter space of time.

Figure 3:
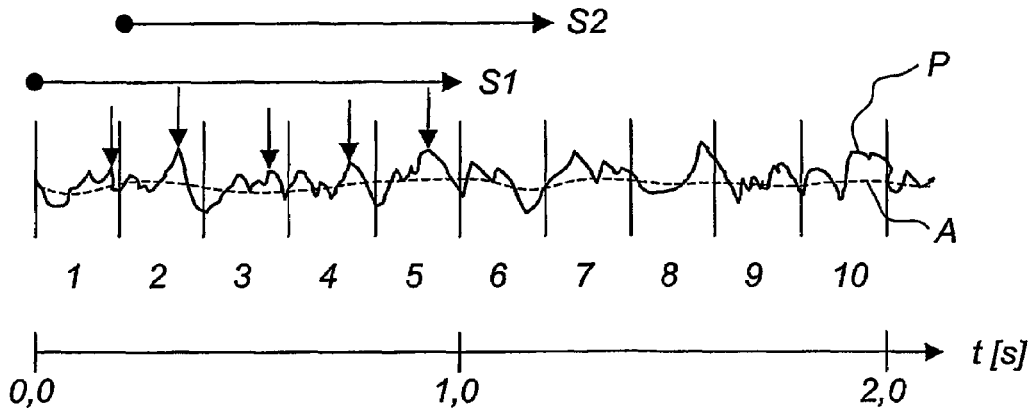
FIG. 3 schematically shows a first embodiment of sequences of measurements of highest hydraulic fluid pressures during consecutive periods of time.

FIG. 3 schematically shows a curve P of measured hydraulic fluid pressure during a period of 2 s. Within each period of time of 0.2 s, the highest hydraulic fluid pressure is recorded during that period of time. In FIG. 3, the periods of time have been numbered from 1 to 10 and the highest hydraulic fluid pressure in each period of time, which hydraulic fluid pressure is stored in the control device 11 in step 24, has for period of time 1 to 5 been marked with an arrow. The mean peak pressure mentioned in step 26 is calculated as a mean value of the highest hydraulic fluid pressures from the respective period of time 1 to 5, which are included in a first sequence S1 of repeated measurements of highest hydraulic fluid pressures. In the iteration following next, i.e., when step 24 again has been commenced, the highest hydraulic fluid pressure in period of time no. 6 will be stored in the control device 11, a new mean peak pressure being calculated from the highest hydraulic fluid pressures from the respective period of time 2 to 6, which are included in a second sequence S2 and so on. Thus, a new mean peak pressure will be calculated five times per second and said mean peak pressure will be based on the respective highest hydraulic fluid pressures which have been measured during the five latest periods of time.

Figure 4:
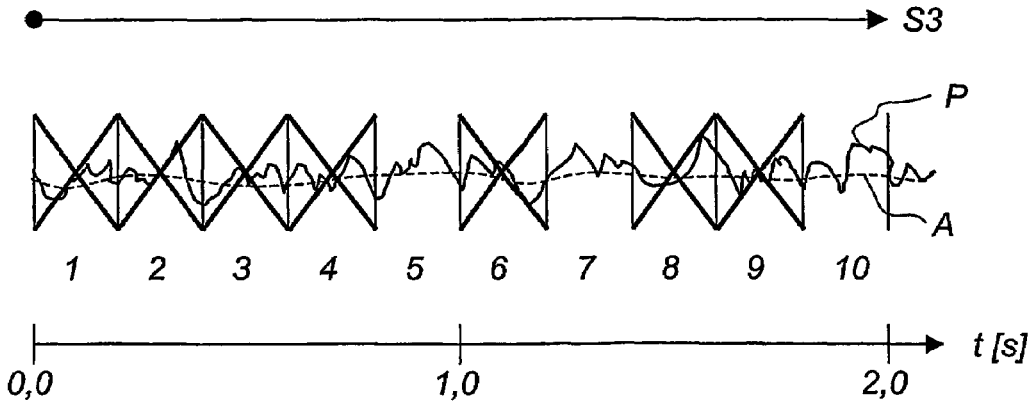
FIG. 4 schematically shows a second embodiment of a sequence of measurements of highest hydraulic fluid pressures during consecutive periods of time.

FIG. 4 schematically shows an even more preferred embodiment, wherein a sifting of the respective highest hydraulic fluid pressures is made before a mean peak pressure is calculated. In this even more preferred method, step 26 has been configured according to the following. The respective highest hydraulic fluid pressures from the latest 10 periods of time are compared, the two highest values and the five lowest values being sifted away. A mean peak pressure is then calculated as a mean value of the remaining 3 periods of time and is utilized in step 28. FIG. 4 shows a schematic illustration of how the sifting has taken place in a sequence S3 of repeated measurements of highest hydraulic fluid pressures. The periods of time which have the two highest and the five lowest values, respectively, of highest hydraulic fluid pressure have been sifted away, which is symbolized by they having been crossed over in FIG. 4. Thanks to the fact that more of the lowest than of the highest values of highest hydraulic fluid pressure are excluded, the mean peak pressure, which later is correlated to the desired value, will be more sensitive to the highest pressures. Thus, the control system will react faster on pressure increases than on pressure reductions, which decreases the risk of mechanical breakdowns caused by too high pressures. Thus, the mean peak pressure is calculated as a mean value of the highest hydraulic fluid pressures during those periods of time of the periods of time 1 to 10 that have not been sifted away. Table 1 below indicates how the analysis, which takes place in the control device 11, may look like:

TABLE 1

Example of calculation of mean peak pressure

| Measure | Values after measure |
|---|---|
| Measure instantaneous hydraulic fluid pressures | 2.5 2.8 4.3 4.1 4.5 4.4 etc. |
| Form sequence of highest pressure in each one of ten periods of time | 4.5 3.4 6.5 5.4 5.6 3.3 5.7 6.2 4.9 5.8 |
| Take away the five lowest pressures in the sequence | 6.5 5.6 5.7 6.2 5.8 |
| Take away the two highest pressures in the sequence | 5.6 5.7 5.8 |
| Calculate mean value of the three remaining pressures in the sequence | 5.70 |

The control device 11 suitably also measures the mean hydraulic fluid pressure. The mean hydraulic fluid pressure is a measure of the load of the crusher and should be as high as possible. In FIG. 3 and FIG. 4, the mean hydraulic fluid pressure has been marked with a dashed curve A. Thus, the mean hydraulic fluid pressure is an average of all measured instantaneous hydraulic fluid pressures during the preceding 2.0 s. In efficient operation of the crusher, the mean hydraulic fluid pressure, i.e., curve A, should be close to the calculated mean peak pressure, i.e., the mean value of the highest hydraulic fluid pressures measured during respective period of time. Accordingly it is desirable to keep the hydraulic fluid pressure on an even and high level. In such an operation, the crusher will be utilized maximally for crushing without the risk of increasing mechanical breakdowns.

Figure 5:
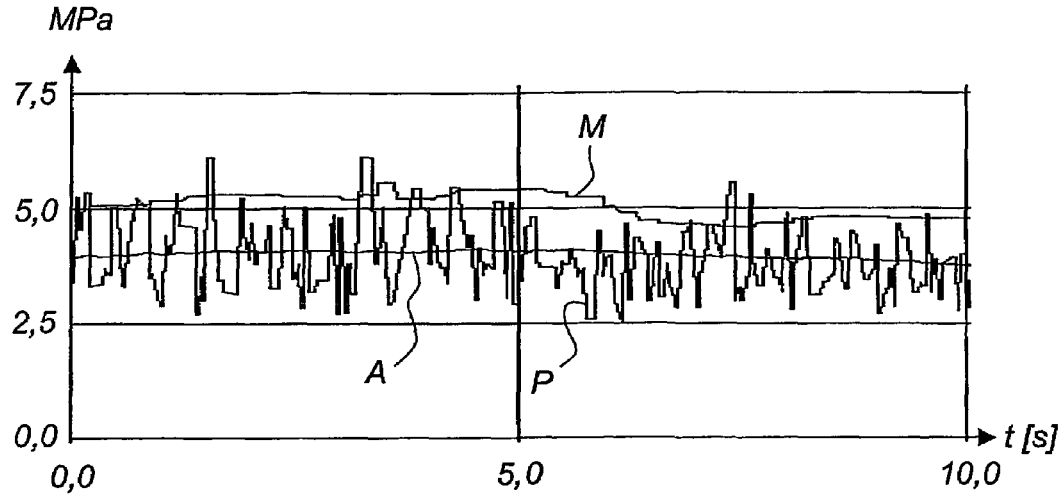
FIG. 5 shows a typical geometry of a hydraulic fluid pressure curve in an efficiently operating crusher.

FIG. 5 shows a typical geometry of a hydraulic pressure curve P in an efficiently operating crusher. In this case, the desired value of mean peak pressure was predetermined to 5.0 MPa. The mean peak pressure M varies between approx. 4.5 and 5.5 MPa. As is seen in FIG. 5, the mean hydraulic fluid pressure A is approx. 4 MPa, i.e., only somewhat below the calculated mean peak pressure M. This is provided by the fact that the supply of material to the crusher is handled in such a way that the flow of material is even and contains material having approximately the same size distribution, moisture content and hardness.

Figure 6:
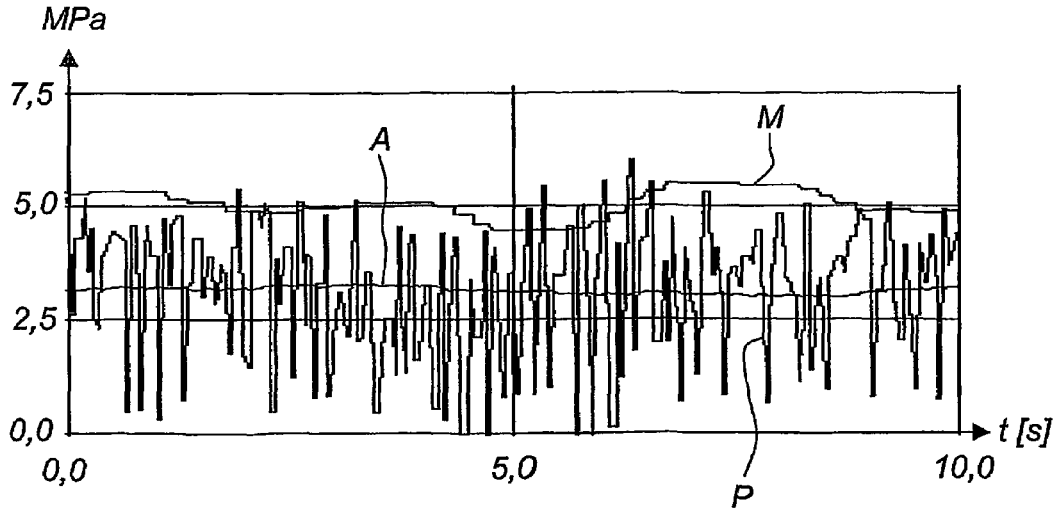
FIG. 6 shows a typical geometry of a hydraulic fluid pressure curve in a crusher, which does not operate efficiently.

FIG. 6 shows a typical geometry of a hydraulic fluid pressure curve P for a crusher of the same type as above but at substantially varying load, which, for instance, may depend on the amount of material and/or the size distribution of the material varying relatively much. The desired value of mean peak pressure was also in this case 5.0 MPa. The mean peak pressure M varies between approx. 4.5 and 5.5 MPa. Thus, the control device 11 can, also on substantially varying load, keep the mean peak pressure M within narrow margins, wherein mechanical breakdowns may be avoided also, for instance, upon uneven supply and operational disturbances. As is seen in FIG. 6, the mean hydraulic fluid pressure A is on approx. 3.2 MPa, which is considerably below the mean peak pressure M and, therefore, the crusher operates with relatively low efficiency.

Figure 7:
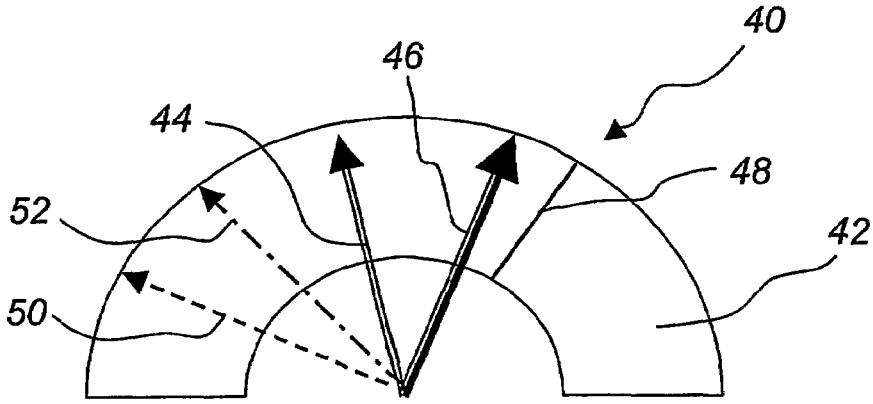
FIG. 7 shows a first embodiment of a pointer instrument, which visually shows how efficiently the operation of the crusher is.

FIG. 7 shows a pointer instrument 40, which visually shows how efficiently the operation of the crusher is. The pointer instrument 40 has a dial 42 and two pointers in the form of needles 44, 46. A first needle 44 shows a comparative value in the form of the mean hydraulic fluid pressure in the crusher. A second needle 46 shows a representative value in the form of the mean peak pressure, i.e., the mean value of the highest hydraulic fluid pressures that have been measured during a number of periods of time, which accordingly is a value which is representative of the highest measured instantaneous hydraulic fluid pressures and which has been calculated according to the above. The distance between the first needle 44 and the second needle 46 is an indication of how efficiently the crusher operates. The desired value of the mean peak pressure has been marked with a line 48 on the dial 42 of the pointer instrument. In the position that is shown in FIG. 7, the mean peak pressure, which is shown by the second needle 46, is incidentally lower than the desired value. Thus, the control device 11 will instruct the pump 8 to pump in more hydraulic fluid so that the crushing head 3 is raised and the hydraulic fluid pressure increases again.

In FIG. 7, a third pointer is also shown in the form of a dashed third needle 50, which is included in an alternative design of the pointer instrument 40. The needle 50 is utilized in order to show a difference calculated by the control device 11 between the mean hydraulic fluid pressure and the mean peak pressure with the purpose of more clearly illustrating how efficiently the crusher operates.

In FIG. 7, also a fourth pointer is shown in the form of a dashed and dotted fourth needle 52, which is included in an additional alternative design of the pointer instrument 40. The needle 52 is utilized in order to show a comparative value calculated by the control device 11 in the form of a mean bottom pressure. The mean bottom pressure is calculated according to the same principle as has been described above for the mean peak pressure, but is instead based on the lowest measured hydraulic fluid pressures. Thus, the mean bottom pressure is calculated as a mean value of the lowest hydraulic fluid pressures that have been measured during a number of consecutive periods of time, and thereby represents the lowest loads on the crusher. The distance between the fourth needle 52, which shows the mean bottom pressure, and the second needle 46, which shows the mean peak pressure, thus illustrates how large the variation in load on the crusher is. The fourth needle 52 may be used together with the first needle 44, which shows the mean pressure, or replace the same, wherein the needle 52 will work as a first pointer that then, together with the second needle 46, which shows the mean peak pressure, illustrates the operation condition in the crusher. It is also possible to calculate the difference between the mean peak pressure and the mean bottom pressure and let a fifth pointer, not shown in FIG. 7, show this difference.

Figure 8A:
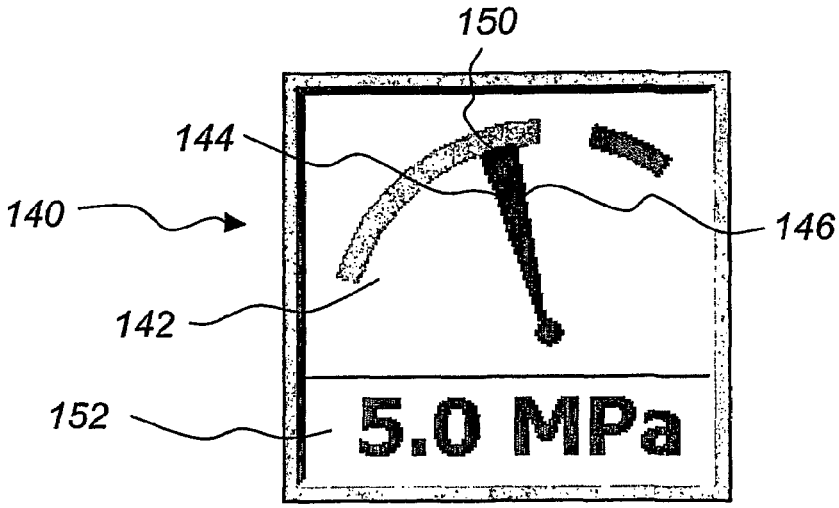
FIG. 8*a* shows a second embodiment of a pointer instrument, which shows the operation in an efficiently operating crusher.

FIG. 8*a* shows another embodiment in the form of a pointer instrument 140. The same pointer instrument 140 is formed as a virtual window, which is shown on a display device, for instance a display device included in the control device 11. The pointer instrument has a dial 142, a first pointer 144, which shows the mean hydraulic fluid pressure, and a second pointer 146, which shows the mean peak pressure, i.e., the mean value of the highest hydraulic fluid pressures which have been measured during a number of periods of time. The first and the second pointer 144 and 146, respectively, form between themselves a sector 150 that has another color, for instance black, than the dial 142 and therefore is clearly seen. Thus, the extension of the sector 150 on the dial 142 becomes a visually easy-to-read measure of how efficiently the crusher operates. The position of the first pointer 144 is updated each time a new mean hydraulic fluid pressure has been calculated and the position of the second pointer 146 is updated each time a new mean peak pressure has been calculated. The pointer instrument 140 shown in FIG. 8*a* illustrates the condition in the crusher, the hydraulic fluid pressure curve P of which is shown in FIG. 5, i.e., an efficiently operating crusher.

The pointer instrument 140 has also a virtual display 152 that, for instance, may display the current mean peak pressure, mean hydraulic fluid pressure or the difference between these pressures.

Figure 8B:
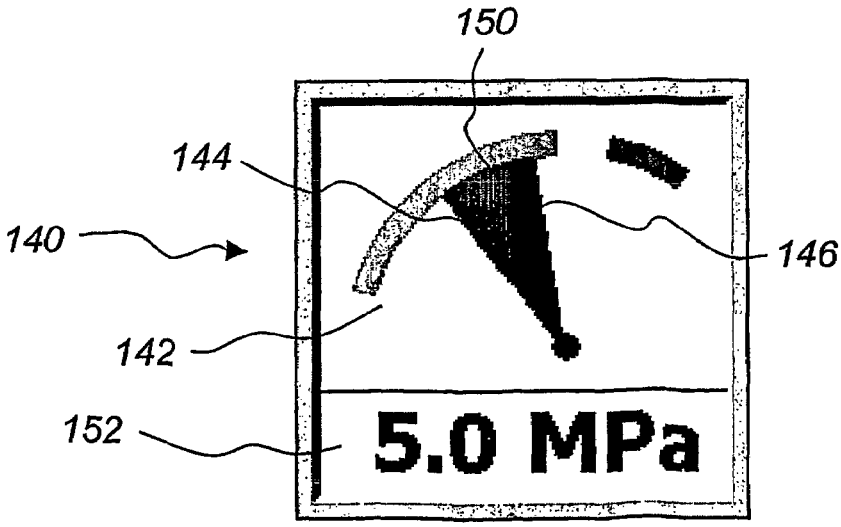
FIG. 8*b* shows a pointer instrument which is of the same type as the one shown in FIG. 8*a*, but which shows the operation in an inefficiently operating crusher.

In FIG. 8*b*, a pointer instrument 140 is shown of the same type as the one shown in FIG. 8*a*. However, the pointer instrument 140 shown in FIG. 8*b* illustrates the condition in the crusher, the hydraulic fluid pressure curve P of which is shown in FIG. 6, i.e., a crusher which does riot operate efficiently by virtue of substantially varying load. As is seen in FIG. 8*b*, the sector 150 has a large extension on the dial 142 since the mean hydraulic fluid pressure, which is shown by the pointer 144, is considerably lower than the mean peak pressure, which is shown by the pointer 146, which clearly indicates to the operator that measures needs to be taken in order to increase the efficiency of the crusher.

Figure 9:
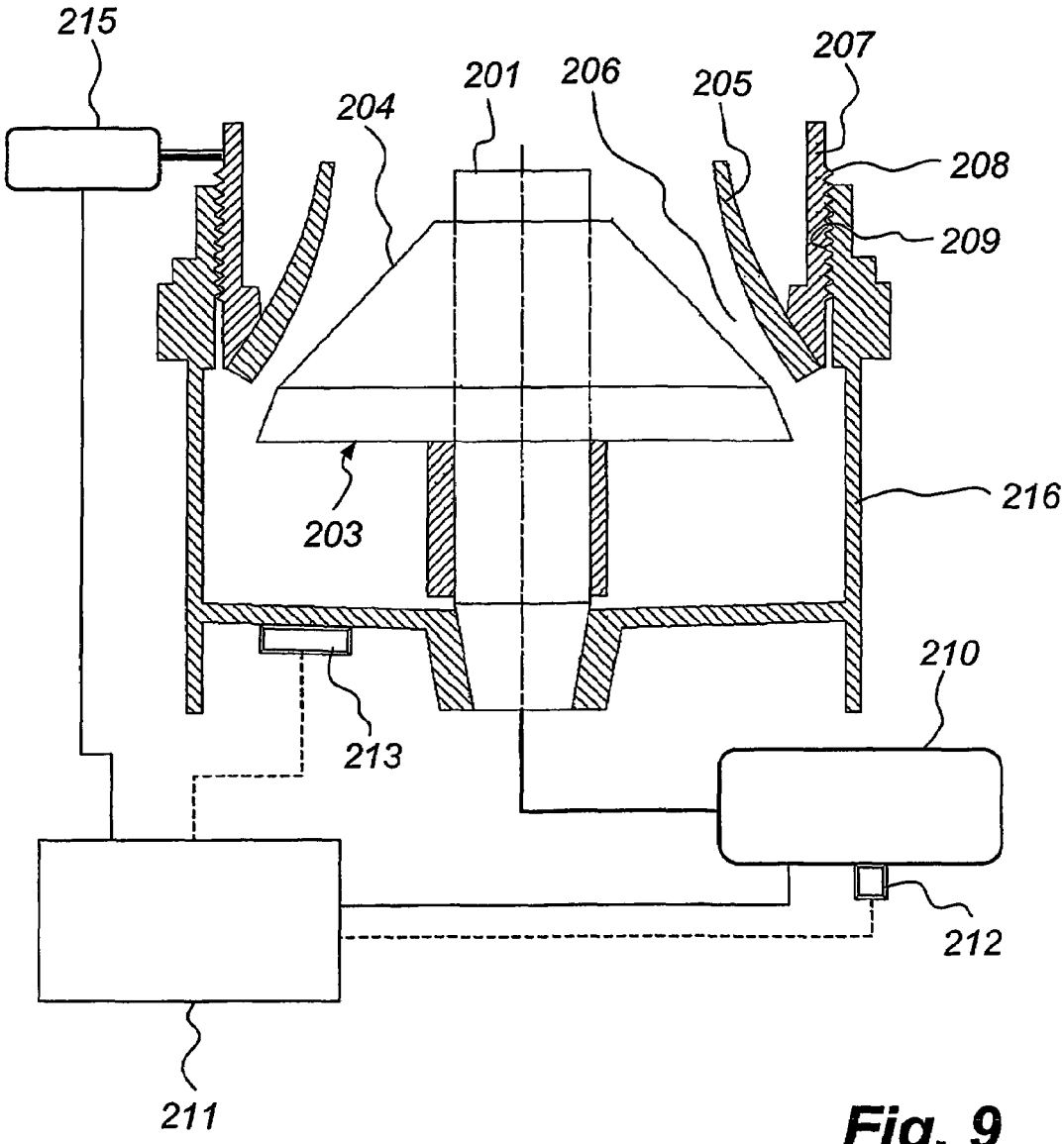
FIG. 9 shows a gyratory crusher having mechanical adjusting of the width of the gap.

FIG. 9 schematically shows a gyratory crusher that is of another type than the crusher shown in FIG. 1. The crusher shown in FIG. 9 has a shaft 201, which carries a crushing head 203 having a first crushing means in the form of an inner crushing shell 204 mounted thereon. Between the inner shell 204 and a second crushing means in the form of an outer crushing shell 205, a crushing gap 206 is formed. The outer crushing shell 205 is attached to a case 207 that has a trapezoid thread 208. The thread 208 mates with a corresponding thread 209 in a crusher frame 216. Furthermore, a motor 210 is connected to the crusher, which is arranged to bring the shaft 201, and thereby the crushing head 203, to execute a gyratory movement during operation. When the case 207 is turned by an adjustment motor 215 around the symmetry axis thereof, the outer crushing shell 205 will be moved vertically, the width of the gap 206 being changed. In this type of gyratory crusher, accordingly the case 207, the threads 208, 209 as well as the adjustment motor 215 constitute a adjusting device for adjusting of the width of the gap 206. Upon control of the load on a crusher of this type by means of a control device 211, it is according to the invention possible to utilize a transducer 212, which measures the instantaneous power generated by the motor 210. From the highest measured powers during a number of periods of time, subsequently a mean peak power may be calculated and compared with a desired value. Depending on said comparison, the load on the crusher is controlled. The same control may, for instance, consist of the adjustment motor 215 being instructed to turn the case 207 in order to alter the width of the gap 206. It is also possible to alter the supply of material, the number of revolutions of the motor 210 and/or the stroke of the shaft 201 in the horizontal direction.

An alternative method to measure the load, which method works both in crushes having hydraulic adjusting devices and crushes of the type which is shown in FIG. 9, is to measure a mechanical stress or tension in the proper crusher. As is seen in FIG. 9, a strain gauge 213 has been placed on the crusher frame 216. The strain gauge 213, which measures the instantaneous strain in the part of the frame 216 to which it is attached, is suitably placed on a location on the frame 216 which gives a representative picture of the mechanical load on the crusher. From the highest measured strains, possibly converted to corresponding tensions, during a number of periods of time, a mean peak strain or tension may then be calculated and utilized in order to control the load on the crusher.

Figure 10:
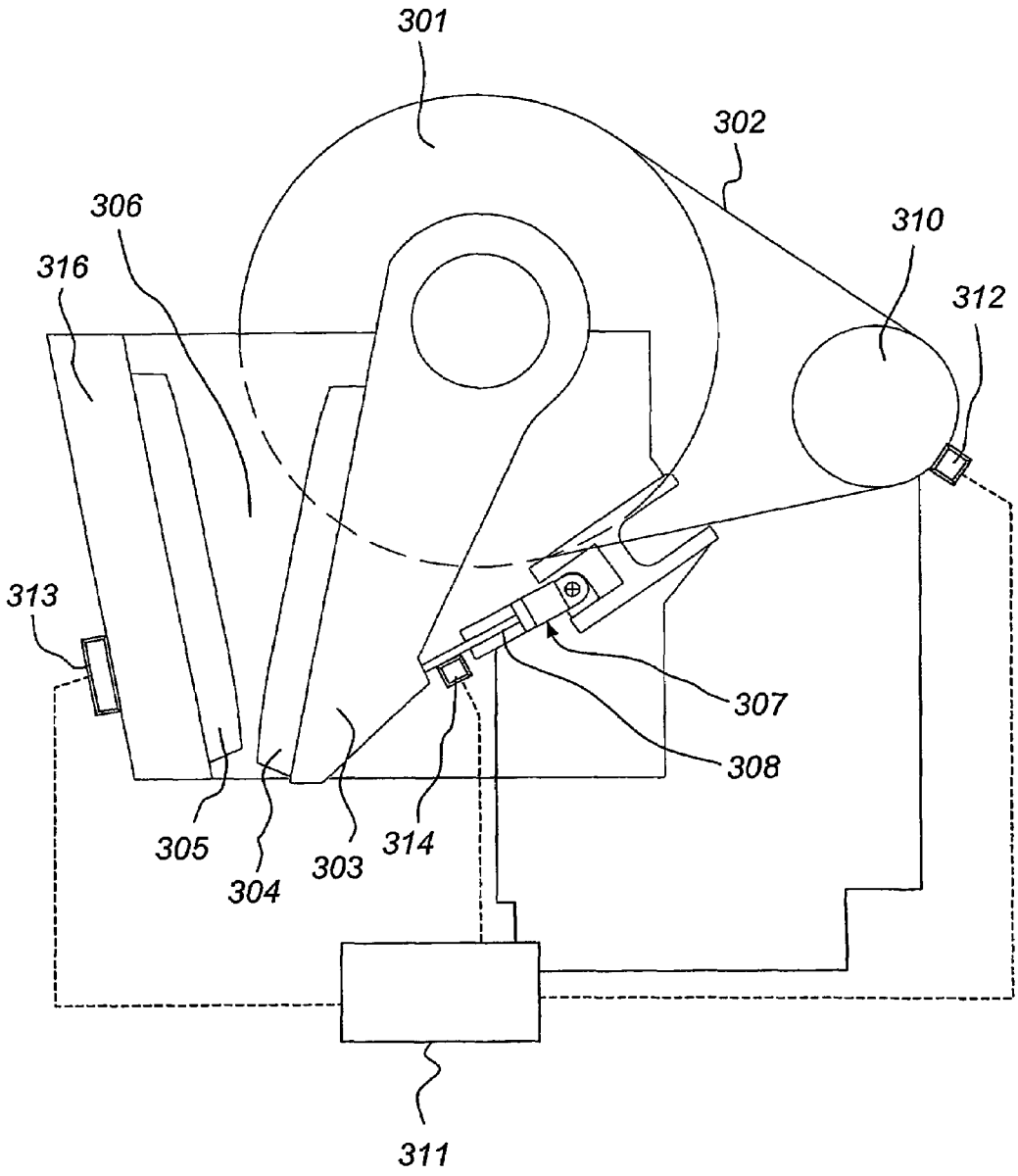
FIG. 10 shows a jaw crusher and associated driving, adjusting and controlling devices.

FIG. 10 schematically shows a jaw crusher. The jaw crusher has a frame 316 and a movable jaw 303 movably mounted therein. The movable jaw 303 carries a first crushing means in the form of a first crushing plate 304. The frame 316 carries a second crushing means in the form of a second crushing plate 305. A crushing gap 306 is formed between the first crushing plate 304 and the second crushing plate 305. The jaw 303 is rotatably and eccentrically secured at its upper end to a flywheel 301. The flywheel 301 is driven via a belt 302 by a driving device in the form of a motor 310 and thereby gets the upper portion of the jaw 303 to describe a substantially elliptical movement which causes material fed into the gap 306 to be crushed by the crushing plates 304, 305. The lower end of the jaw 303 is supported by a toggle plate 307. The toggle plate 307 has a hydraulic cylinder 308, which makes it possible to adjust the width of the gap 306. At this type of crusher the toggle plate 307 and the hydraulic cylinder 308 an adjusting device for adjustment of the width of the gap 306. At control of the load on a crusher of this type by means of the control device 311 it is according to the present invention possible to use a gauge 312 that measures the instantaneous power that develops at the motor 310 and sends a signal to the control device 311. A mean peak power can then be calculated from the highest measured powers during a number of periods of time in accordance with what has been described above and be compared to a desired value. The load on the crusher is controlled depending of this comparison. This control may for example consist in the control device 311 orders the hydraulic cylinder 308 to change the width of the gap 306. It is also possible to order change of feed of material to the crusher or of the rotational speed of the motor 310.

It is also possible to measure e mechanical load or tension in the crusher itself. As is apparent from FIG. 10 a strain gauge 313 has been positioned on the crusher frame 316. The strain gauge 313 that measures the instantaneous strain in the portion of the frame 316 on which it is secured, can be used in a similar way as described above regarding the gauge 213. Another possibility is to position a strain gauge 314 on the toggle plate 307 for measuring the instantaneous load on the toggle plate 307 and to send a signal to the control device 311 that uses that signal for controlling the crusher. It is also possible to measure the hydraulic fluid pressure in the hydraulic cylinder 308 of the toggle plate 307 and to use said pressure as a measure on the load on the crusher. It is understood that the toggle plate 307 is schematically shown and that other devices and other types of toggle plates may be used for adjusting the width of the gap 306.

It will be appreciated that a number of modifications of the above-described embodiments are feasible within the scope of the invention, such as it is defined by the appended claims.

The representative value that is representative of the highest measured instantaneous loads may, for instance, be calculated as a mean peak pressure according to what has been described above. There are, however, a plurality of other methods to calculate said representative value. For instance, a standard deviation from the mean load may be calculated and utilized as said value. A small standard deviation is then an indication of the crusher operating efficiently. An additional alternative is to take both the height and duration of the respective load peak into consideration. For instance, the extension of the peaks in time and height may be calculated by integration, said value being calculated as a mean value of a number of integrated peaks.

Two consecutive sequences of data may either partly overlap each other, such as has been described above, or follow immediately upon each other instead of partly utilizing the same data.

It will be appreciated that a person skilled in the art by experiments can derive lengths of the periods of time suitable for certain specific operation conditions, how many periods of time that should be included in a sequence, how many data in a sequence that should be retrieved from a preceding sequence and if any data should be sifted away before calculation of mean values and that the above-described statements constitute a preferred example. For instance, a suitable length of each period of time has turned out to be 0.05 to 1 s.

Above is described how the control device 11 controls the hydraulic fluid pressure depending on a comparison of said representative value, which, for instance, may be a mean peak pressure, with a desired value of the pressure. However, the control device 11 may also be arranged to take the load of the motor into consideration. If the signal from the transducer 12, which measures the load of the motor 10, indicates that the load on the motor 10 exceeds an allowed load value, the control device 11 will instruct the pump 8 to decrease the hydraulic fluid pressure, also if the mean peak pressure does not exceed the desired value of pressure, in order to avoid overload of the motor 10.

Above a method for controlling the crusher is described where it is desirable to keep highest feasible load and size reduce the material as much as possible. The control device 11 aims, in that connection, at keeping a high hydraulic fluid pressure and makes this by continuously keeping the gap 6 as narrow as possible, the supplied material being exposed to a maximum size reduction. In certain cases, it is instead of interest to keep a fixed width of the gap 6 in order to provide a certain size of the crushed product. In such a case, the control device 11 can instead be utilized as a safety function that incidentally increases the gap somewhat in order to reduce the hydraulic fluid pressure when the calculated mean peak pressure during any shorter period exceeds the desired value of pressure. Therefore, in this way, a larger quantity of supplied material can be crushed to a certain desired size without risk of mechanical breakdown. It also becomes considerably simpler to maximize the quantity of material that can be crushed to the desired size. An additional possibility is to let the crusher alternatingly operate in control towards maximum load and in control to a fixed gap. It is also possible to keep the width of the gap 6 constant and instead control the load on the crusher by means of some other parameter, for instance the amount of supplied material.

It is understood the width of the crushing gap 6, 206, 306 can be adjusted in different ways and that the above-described methods, reference being had to FIGS. 1, 9 and 10, are non-limiting examples.

The above described pointer instruments 40; 140 are provided with needles 44, 46 and pointers 144, 146, respectively, which may be mechanical or be shown on a display device. It is however also possible instead to utilize digital display of the actual numbers concerning the mean hydraulic fluid pressure and mean peak pressure, which have been calculated. Thus, in this case, the pointer of the pointer instrument will consist of displays that suitably digitally, show calculated numbers. It is, as is mentioned above, also possible to calculate the difference between the mean hydraulic fluid pressure and the mean peak pressure and let a third pointer, which may be a needle 50 or a display showing the number in question, show said difference. The difference between mean hydraulic fluid pressure and mean peak pressure may thereby be used for following-up of the operation of the crusher, a small difference meaning, as mentioned above, that the crusher operates efficiently. It is also possible to combine display with needles and display of numbers in question and to in that connection utilize needles in order to show mean hydraulic fluid pressure and mean peak pressure and a display in order to show the calculated difference between the same.

It is also possible to form a pointer instrument having a sector that is formed between a second pointer, which shows the mean peak pressure, and a fourth pointer, which shows the mean bottom pressure. A first pointer, which shows the mean pressure, may be imparted another color than the sector and is placed on top of the same in order to also show the mean pressure in the adjusting device.

The invention claimed is:

1. A method for controlling a crusher which includes first and second crusher elements spaced apart to form a gap into which material to be crushed is introduced, the method comprising the steps of:

A. measuring an instantaneous load multiple times during each of a plurality of time periods to obtain multiple load measurement values in each time period, and forming a sequence of data from the highest loads in the respective time periods, B. calculating a mean value from the sequence of data from the highest loads in the respective time periods, C. comparing the mean value to a reference value, and D. controlling the load on the crusher in accordance with such comparison.

2. The method according to claim 1 wherein the periods of time follow immediately after one another.

3. The method according to claim 1 wherein step A comprises processing the load measurement values continuously during a crushing operation for forming a plurality of sequences of data.

4. The method according to claim 3 wherein upon calculation of a representative value of a current sequence, at least one data is utilized concerning highest load already utilized in an immediately preceding sequence.

5. The method according to claim 1 wherein at least the highest value of data included in the sequence concerning highest load is excluded upon calculation of said representative value of such sequence.

6. The method according to claim 1, wherein at least the lowest value of the data included in the sequence concerning highest load is excluded upon calculation of said representative value of such sequence.

7. The method according to claim 1, wherein at least the highest as well at least the two lowest values of the data included in the sequence concerning highest load are excluded upon calculation of said representative value of said sequence, more of the lowest than of the highest values being excluded.

8. Method according to claim 1, wherein the width of the gap is adjusted by a hydraulic adjusting device, and wherein in step A the load is measured as a function of hydraulic fluid pressure in said adjusting device.

9. Method according to claim 1, wherein in step A the load is measured as a function of the power of the driving device.

10. The method according to claim 1, wherein in step A the load is measured as a function of mechanical stress on the crusher.

11. The method according to claim 1, wherein in step A the load is measured as a function of at least two of the parameters comprised of:

hydraulic fluid pressure in a hydraulic adjusting device, the power of the crusher driving device, and a mechanical stress in the crusher, wherein the one of those parameters which is highest in relation to the reference value is utilized in step C.

12. The method according to claim 1, wherein in step C the load is controlled by at least one of the following steps:

changing the width of the gap, changing the supply of material to the gap, adjusting the rpm of a crusher driving device, and adjusting the relative movements of the crusher elements.

13. A control system for controlling the load on a crusher which includes first and second crusher elements spaced apart to form a gap into which material to be crushed is introduced, the system comprising:

a measuring device arranged to measure an instantaneous load on the crusher multiple times during each of a plurality of time periods to obtain multiple load measurement values in each time period, a calculation device arranged to form a sequence of data from the highest loads in the respective time periods, and calculate a mean value of such data, a control device arranged to compare said mean value with a desired value and to control the load on the crusher depending on said comparison.

* * * * *